United States Patent [19]

Steeves

[11] 4,177,310

[45] Dec. 4, 1979

[54] METHOD OF METALLIZING PAPER

[75] Inventor: Robert W. Steeves, Nahant, Mass.

[73] Assignee: King Seeley Thermos Company, Winchester, Mass.

[21] Appl. No.: 928,587

[22] Filed: Jul. 27, 1978

[51] Int. Cl.[2] ..... B05D 3/06

[52] U.S. Cl. ..... 428/216; 427/42; 427/44; 427/250; 427/404; 427/407 R; 427/411; 428/458; 428/481

[58] Field of Search ..... 427/42, 44, 250, 404, 427/407 R, 411; 428/457, 458, 481, 535, 213, 215, 216

[56] References Cited

U.S. PATENT DOCUMENTS

| | | | |
|---|---|---|---|
| 2,971,862 | 2/1961 | Baer et al. | 427/250 |
| 3,463,659 | 8/1969 | Dragoon et al. | 427/411 |
| 3,480,464 | 11/1969 | Lacy | 427/250 |
| 3,984,500 | 10/1976 | Dickie et al. | 427/404 |
| 3,992,477 | 11/1976 | Dickie et al. | 427/404 |
| 4,039,722 | 8/1977 | Dickie et al. | 427/250 |

*Primary Examiner*—John H. Newsome

*Attorney, Agent, or Firm*—Harness, Dickey & Pierce

[57] ABSTRACT

A metallized paper product useful in packaging and decorating applications is provided by a process of coating a paper substrate with a radiation curable resin precursor, curing the precursor by immediately contacting the precursor with an electron beam to provide a smooth resin film and then vacuum metallizing a thin layer of metal on the resin film.

19 Claims, 2 Drawing Figures

METHOD OF METALLIZING PAPER

BACKGROUND OF THE INVENTION

The present invention relates to a modified paper product and a method for making the product. More particularly, the present invention relates to a metallized paper product made by coating a thin metal layer onto a resin-coated paper surface.

While it is known to laminate metal onto a paper substrate, considerable difficulties have been encountered by attempts to deposit an extremely thin film of metal on a paper substrate to provide a useful flexible product. For example, one metallizing method capable of efficiently coating a thin layer of metal on a substrate is the vacuum metallizing process wherein aluminum or other metal is evaporated in a vacuum chamber and condensed onto a surface of the substrate material. However, a paper substrate has a relatively rough surface upon which it is difficult to provide a smooth, thin metal coating. Furthermore, the vacuum levels required in vacuum metallizing processes are extremely low, on the order of 0.0001 Torr, and paper has an inherent affinity for moisture which outgasses as water vapor under such low pressure conditions thereby raising the pressure inside the vacuum chamber. This outgassed water vapor in the chamber must be substantially removed by either freezing or pumping it out in order to maintain a low vacuum condition. Even if it is so removed outgassing interferes with the condensation of metal onto the paper surface.

Efforts to overcome the problems caused by outgassing have included selecting paper substrates having low water content, pre-outgassing paper in separate chambers prior to metallizing and then later restoring water content to the paper, and coating or impregnating paper with clay, waxes or resins applied with solvents. However, none of these efforts have been entirely satisfactory and commercial processes for metallizing of paper have not developed to the same extent as have processes for metallizing plastic films and laminating metal foil to paper, even though these latter processes involve use of more expensive substrates, use of greater amounts of metal, may provide thicker products and have their own process difficulties.

Wherefore, it is an object of the present invention to provide an improved method for providing a thin metal layer on a paper substrate. It is another object of this invention to provide an improved paper product comprising a paper substrate having a thin metal coating thereon. Yet another object of the invention is to provide a method particularly suited for continuous, high speed operation and which is economical and energy efficient. A still further object of this invention is to provide a paper product having good strength and flexibility and which is useful for packaging, decorative and other applications and which has a metallized surface which can be conventionally printed. These and other objects features and advantages will be apparent from the following description and appended claims, taken in conjunction with the accompanying drawing.

DESCRIPTION OF THE INVENTION

Figure 1:
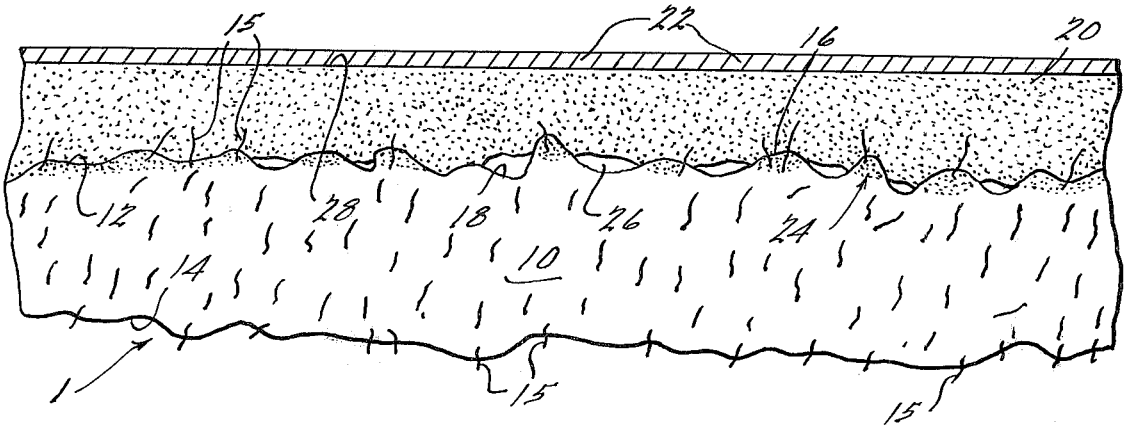
FIG. 1 is a sectional view of a metallized paper product of the present invention.

Now referring to the drawing, FIG. 1 shows a paper substrate 10 with a surface 12 and an opposite surface 14, of an irregular nature having fibers 15 extending therefrom and peaks 16 and valleys 18. Surface 12 is coated with resin film 20 which is itself coated with a metal layer 22. Resin film 20 is impregnanted a small distance into paper substrate 10 as indicated at areas 24. The irregularity of surface 12 and degree of hold out of resin film 20 is such that pockets or holes 26 are trapped between resin film 20 and paper substrate 10. However surface 28 of resin film 20 is relatively smooth. Paper substrate 10, resin film 20 and metal layer 22 are not shown to scale but can suitably have a depth or thickness of about 10 mil, 0.1 mil, and 1 micro-inch respectively. Materials, sizes and other characteristics of the modified paper product of the present invention will be understood from the disclosure relating to the method of this invention which is set forth hereinafter.

Figure 2:
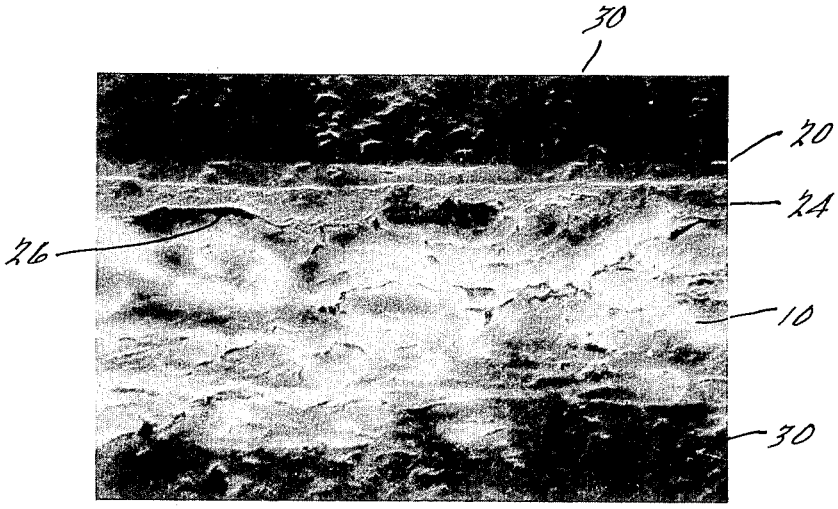
FIG. 2 is a 1,000× magnification photomicrograph of a section through a metallized paper product of the present invention.

FIG. 2 is a photomicrograph of a section through a paper substrate 10 with resin film 20 coated on one surface thereof and shown sandwiched between layers 30 of epoxy resin used for purposes of obtaining the cross sectional picture. Pockets 26 and areas 24 of resin-impregnated paper can be seen in the photomicrograph. The thin metal layer 22 however is not shown, being too thin to be seen at this magnification.

The metallized paper product of the present invention is useful in packaging, decorating and other applications. A product made in accordance with this invention is flexible, has good strength, and presents a smooth, metallic surface. It has been found that a desirable product of good characteristics can be economically made by a process wherein a paper substrate is coated with a thin film of an electron-beam curable resin precursor which is immediately cured in situ and then coated with a thin layer of metal by a metal depositing technique such as vacuum metallizing. The resin precursor, when cured, provides a resin film having a relatively smooth and impervious surface as compared to the paper which enhances the brilliance of the metal coating and reduces outgassing during the metallizing step.

Paper substrates suitable for use in the present invention will be flexible and can be provided in roll form so as to be particularly adapted for a continuous process. Typically, the paper will be about 2 to about 20 mils thick and a 15 to 80 lb. (per ream) paper and will have a surface pretreated to provide a smoother surface upon which the resin film of the present invention will be coated. Suitable pretreatments include paper sizing, calendering techniques, or machine glazing or polishing techniques. For example, the paper substrate can be passed over a heated drum rotating at a speed different than the paper substrate thereby polishing, i.e., smoothing the surface of the paper substrate. Speed differentials on the order of about 1:10 or 10:1 are suitable for this purpose. Of course, other conventional means for mechanically leveling or polishing one or both surfaces of the paper substrate are consistent with, and contemplated to be within, the scope of the present invention. It will be appreciated by those skilled in the art from the following disclosure of the present invention that such pretreatments are advantageous to obtain optimum results with minimum amounts of resin precursor and metal materials in practicing the present invention.

In order that the final product will be flexible and to economize on materials, it is necessary that the resin film on the paper substrate be very thin. In general the cross section thickness of the resin film should be from about 0.05 to about 3.0 mils, preferably from about 0.1 to about 0.3 mils. To achieve a resin film of this thickness, the viscosity of the precursor must be sufficiently low so that the precursor will flow onto or wet the paper substrate to form a thin, smooth layer or film. It is also desirable that the resin precursor be of a low viscosity so that it will penetrate or impregnate the adjacent paper substrate surface. By penetrating into the paper substrate, the resin precursor, when cured, provides a strong mechanical bond between the resin film and the paper substrate. It is believed that fibers, including paper fibers and fibers or flake or additive, e.g. clay, of the paper substrate contained in the resin film as composite reinforcements and holding members in an amount of up to about 25% by weight of the resin film is most satisfactory in the present invention. These fibers also are believed to strengthen the resin film itself and further contribute to the total strength of the metallized paper product of this invention.

On the other hand it is necessary that the resin precursor cover fibers or other paper substrate material extending above the surface of the paper substrate to provide a smooth and uninterrupted resin film surface. Furthermore the precursor must not penetrate too far into the paper substrate if the end product is to have the desired flexibility and if use of an excessive amount of resin precursor is to be avoided. Hence, the viscosity of the precursor must be high enough so that penetration into the paper substrate prior to curing is limited to a maximum depth of about one quarter of the thickness of the paper substrate. Preferably the amount of resin precursor is less than 10% by weight of the paper substrate.

Suitable resin precursors have viscosities of from about 1,000 to about 5,000 centipoise at the temperature at which they are applied to the paper substrate. Precursors having viscosities of from about 2,000 to about 3,000 centipoise are preferred while those having viscosities of from about 2,600 to about 2,700 are most preferred. Resin precursors of these viscosities can be applied to the paper substrate by means of a finely etched reverse gravure roll of 100–300 quad, depending on desired film thickness although any method capable of coating a thin film of the resin precursor onto the paper substrate can be used.

It has been found that the desired smooth film of precursor which requires a relatively low viscosity and the desired limited penetration which requires a relatively high viscosity can be obtained by initiating the curing of the precursor of the present invention immediately after coating the paper substrate. This immediate cure can be accomplished by employing radiation curable resin precursors and curing by means of electron beam radiation. The precursor must consist essentially of reactive monomers or oligomers which will substantially completely polymerize. By this is meant that less than 10% and preferably less than 1% of monomeric precursor material will remain after the precursor has been cured. Resin precursors comprising a non-polymerizing solvent are not satisfactory as the solvent contributes to outgassing and is detrimental to achieving the desired smooth film surface. There are many suitable resin precursors specifically designed for electron beam curing and which are commercially available including polyester, urethane, acrylic, epoxy and vinyl-based resin precursors and mixtures thereof. Acrylate substituted urethane resin precursors are preferred.

As indicated above, it is necessary to contact the resin precursor with electron radiation to initiate curing immediately after the resin precursor is applied to the paper substrate. In accordance with this process the resin film is isolated to a surface portion on one side of the cross section thickness of the paper substrate and any substantial detrimental effect on the flexibility of the paper substrate is avoided. By the term "immediate" curing is meant that the curing step is initiated and carried out quickly enough to achieve the above-mentioned results. Generally, the curing step must be initiated within a few seconds of the time that the resin precursor contacts the paper substrate. It has been found that the cure itself is substantially complete within a few milliseconds of exposure of the cured resin precursor to the high energy electron beam. However, several hundred milliseconds may be allowed for transit of the substrate web from a point of application of the cured resin precursor to the curing station. Although the basic cure takes place in a few milliseconds, as mentioned above, additional curing takes place in the web for days and even weeks, but does not limit processing or use of the product at all. The initial cure is characterized by an apparent freedom from tackiness as observed by hand and visually.

The resin precursor can be cured by means of conventional electron beam machinery such as disclosed in U.S. Pat. No. 3,702,412 Nov. 7, 1972 to Quintal, U.S. Pat. No. 3,769,600 Oct. 30, 1973 to Denholm et al. and U.S. Pat. No. 3,780,308 Dec. 18, 1973 to Nablo. These machines provide an electron curtain transverse to movement of a substrate web contacted thereby and can provide a beam or sheet of 2–3 Megarads over 50 to 70 inches of web width which is suitable to cure the resin film in accordance with the present invention. Such machines are available commercially from Energy Sciences, Inc. of Burlington, Mass. under the trade name Electrocurtain ®. Preferably an inert gas is passed over the coated web in the beam working zone to limit oxygen contamination. The inert gas may comprise argon, nitrogen or the like.

After the resin has been substantially cured, a thin layer of metal is deposited thereon in a metallizing step. The metal layer will be on the order of 1 to 2 microinches thick and is less than 1/100th the thickness of the resin film. Suitable metals are those well known in the art and include aluminum, copper, gold, silver, etc. While the curing step must be carried out immediately after application of the resin precursor to the paper substrate, the metallizing step can be carried out at any time after the resin precursor is substantially cured. Preferably metallizing is carried out by vacuum metallizing which is conventional in the art and is described, for example, in texts such as Holland, "Vacuum Metallizing" and in various issued patents. Alternative metallizing methods include other metal depositing techniques such as thermal or catalytic decomposition, electrolytic and electrophoretic deposition, sputtering and ion deposition techniques. The coated substrates of this invention can be metallized at high rates normally associated with the processing of plastic films.

In an alternative but less preferred embodiment of the present invention, the resin precursor coating is applied to the both surfaces of the paper substrate to substantially completely eliminate outgassing in vacuum chambers or for decorative purposes. Both coatings can then be metallized or where no metallization is applied to the back side, the resin coating thereon can be applied with less concern for surface smoothness. However, the additional expense of coating both paper surfaces is generally not warranted since, for most uses of the present invention, satisfactory results are obtained by coating only one side of the paper substrate.

The modified paper end products made through this invention can be used for decorative furnishings (e.g., drapes, wallpaper), wrapping purposes, such as Christmas wrapping paper, in graphic and printing arts, and in technical applications such as reflective optics, thermal insulation, electrical circuit and component production, food and chemical wrapping or conveying with controlled moisture or other fluid blockage advantages and in clothing exterior layers or liners. Adhesives can be applied over the metallized surface(s) for lamination to other layers (of paper, plastic or metal) or to objects such as boxes, crates, walls. Protective coatings can be applied over the metallization in a manner well known in the metallizing art.

Surprisingly, it is found that the metallized products are printable. This is in contrast to paper and metal foil laminates wherein ink will not stick to the metal foil unless it is precoated with shellac or other material. It is also found that the poisoning effects of metal foil on paper backside are avoided by the process and product of the present invention.

The following example is offered to further illustrate the present invention.

EXAMPLE

A roll of a paper substrate (28 lb./ream paper coated on one surface with a sizing material) is unrolled and passed through an offset gravure printing station having a 200 quad impression roller and which coats a thin film of a radiation curable acrylic resin precursor onto the sized surface of the paper substrate. The precursor has a viscosity of about 2,650 centipoise and is applied to the paper in an amount of about 2 lbs./ream. Less than one second after application to the paper, the paper is passed through an electron beam apparatus where the resin precursor (Mobil 76×414B) is contacted with electron beam radiation until the resin is cured as is evidenced by a lack of tack or sticky feel when touched. The paper is then wound onto a roller and transported to a conventional vacuum metallizing chamber maintained at about $5\times10^{-4}$ Torr and in which the paper is passed over a source of aluminum heated to about 1350° C. with the coated side of the paper facing the source of aluminum. The speed of the paper is about 500 feet per minute and the uncoated side of the paper is maintained, as much as reasonably possible, in contact with chilled rollers to minimize outgassing from this uncoated side of the paper. A 1 micro inch layer of aluminum is deposited onto the resin film and the paper is wound onto a take-up roller and removed from the vacuum chamber. The resulting metallized paper product has good flexibility and has a decorative and shiny metallic layer on one surface. It is found that either or both surfaces of the paper are printable with conventional paper printing techniques.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. The process of metallizing paper comprising the steps of:

(A) coating a surface of a paper substrate with a solventless thin film consisting essentially of a radiation curable resin precursor;

(B) immediately contacting said film with electron radiation sufficient to cure said precursor before said precursor has penetrated into said paper substrate a distance sufficient to cause detrimental stiffening thereof; and (C) metallizing the exposed surface of said film.

2. The process of claim 1 wherein said film is sufficiently thick to cover substantially all fibrous paper material projecting from said surface.

3. The process of claim 2 wherein said film has a thickness after curing of from about 0.05 mils to about 3.0 mils.

4. The process of claim 3 wherein said film is cured before penetrating into said paper substrate more than a quarter of the thickness of said paper substrate.

5. The process of claim 4 wherein said film has imbedded therein, from about 5% to about 25% of paper fibers.

6. The process of claim 5 wherein said resin precursor has a viscosity of from about 1,000 to about 5,000 centipoise.

7. The process of claim 6 wherein said viscosity is from about 2,000 to about 3,000 centipoise.

8. The process of claim 7 wherein said viscosity is from about 2,600 to about 2,700 centipoise.

9. The process of claim 6 wherein said metallizing step is carried out by a vacuum metallizing technique.

10. The process of claim 9 wherein said paper substrate is flexible and has a thickness of from about 2 mils to about 20 mils.

11. The process of claim 10 wherein said metallizing step provides a metal layer on said film which is less than 1/100th the thickness of said film.

12. The process of claim 11 wherein said metal is selected from the group consisting of aluminum, copper, gold and silver.

13. The process of claim 12 wherein said metal is aluminum.

14. The process of claim 11 comprising an additional step of printing on said metal layer.

15. A metallized paper product comprising a paper substrate with a smooth continuous, cured, coherent resin film on one side thereof, said film having limited penetration into the paper substrate, being substantially entirely within the adjacent quarter of the paper cross-section thickness, and further comprising fibrous matter of the paper substrate intermixed in said resin coating up to 25 percent thereof, the outer surface of said resin being overcoated with metal of less than 1/100th thickness of the said resin film.

16. A metallized paper product as recited in claim 15 wherein said resin film is a radiation cured resin film.

17. A metallized paper product in accordance with claim 16 having ink printed on a surface thereof.

18. A metallized paper product as recited in claim 16 wherein said paper substrate has a cross-section thickness of from about 2 to about 20 mils, and said film has a cross-section thickness of from about 0.05 to about 3.0 mils.

19. A metallized paper product as recited in claim 18 wherein said metal is aluminum.

* * * * *

Notice of Adverse Decision in Interference

In Interference No. 100,630, involving Patent No. 4,177,310, R. W. Steeves, METHOD OF METALLIZING PAPER, final judgment adverse to the patentee was rendered Dec. 13, 1983, as to claims 1–13.

[*Official Gazette June 5, 1984.*]